US011650026B2

(12) United States Patent
Hulst et al.

(10) Patent No.: US 11,650,026 B2
(45) Date of Patent: May 16, 2023

(54) SUBSTRATE WITH CAMOUFLAGE PATTERN

(71) Applicant: ERA3 LLC, Merlin, OR (US)

(72) Inventors: Jason Hulst, Grants Pass, OR (US); Dennis Sterling Becklin, Grants Pass, OR (US)

(73) Assignee: ERA3 LLC, Merlin, OR (US)

( * ) Notice: Subject to any disclaimer, the term of this patent is extended or adjusted under 35 U.S.C. 154(b) by 0 days.

(21) Appl. No.: 16/541,056

(22) Filed: Aug. 14, 2019

(65) Prior Publication Data

US 2020/0056861 A1 Feb. 20, 2020

Related U.S. Application Data

(60) Provisional application No. 62/718,887, filed on Aug. 14, 2018.

(51) Int. Cl.
*F41H 3/00* (2006.01)

(52) U.S. Cl.
CPC ..... *F41H 3/00* (2013.01)

(58) Field of Classification Search
CPC ..... F41H 3/00; F41H 3/02; B44F 3/00; B44F 7/00
See application file for complete search history.

(56) References Cited

U.S. PATENT DOCUMENTS

| | | | | |
|---|---|---|---|---|
| D13,959 | S | 5/1883 | Swapp | |
| D63,451 | S | 12/1923 | Bunting | |
| D88,854 | S | 1/1933 | Bridier | |
| D88,872 | S | 1/1933 | Gottesman | |
| D94,472 | S | 2/1935 | Forstmann | |
| D124,942 | S | 1/1941 | Meyer | |
| D180,816 | S | 8/1957 | Bergen et al. | |
| 3,967,026 | A | 6/1976 | Dalblom | |
| 4,656,065 | A | 4/1987 | Yacovella | |
| 5,549,938 | A * | 8/1996 | Nesbitt | F41H 3/00 296/191 |
| 5,753,323 | A | 5/1998 | Andrus | |
| D430,732 | S | 9/2000 | Baik | |
| D471,720 | S | 3/2003 | Simmons | |

(Continued)

FOREIGN PATENT DOCUMENTS

WO 98/42219 10/1998

OTHER PUBLICATIONS

Ocean depth Map Wallpaper via Spoonflower website, comment from 7 years ago (~2014) https://www.spoonflower.com/en/wallpaper/1440062-ocean-depth-map-by-ravynka (Year: 2014).*

(Continued)

*Primary Examiner* — Laura C Powers
(74) *Attorney, Agent, or Firm* — Lowe Graham Jones PLLC

(57) ABSTRACT

A camouflage pattern includes a plurality of shapes each having one of a plurality of base colors. Each shape has different portions having a different shade of the base color of that shape. An outermost portion extends around the shape and remaining portions are each surrounded by another portion of the portions. The shades of the base color may go from light to dark or from dark to light moving inwardly from the perimeter of the shape.

17 Claims, 6 Drawing Sheets
(2 of 6 Drawing Sheet(s) Filed in Color)

(56) References Cited

U.S. PATENT DOCUMENTS

| | | | | |
|---|---|---|---|---|
| 6,562,739 | B1 * | 5/2003 | Correll | D06N 3/0059 2/900 |
| D485,685 | S | 1/2004 | Zupkofska et al. | |
| D485,992 | S | 2/2004 | Zupkofska et al. | |
| D501,091 | S | 1/2005 | McGahee | |
| D560,915 | S | 2/2008 | Crye et al. | |
| D615,762 | S | 5/2010 | Kimmel | |
| 8,013,776 | B2 | 9/2011 | Child | |
| D656,323 | S | 3/2012 | Jeronimo | |
| D663,959 | S | 7/2012 | Brookman | |
| D670,085 | S | 11/2012 | Brookman et al. | |
| D685,999 | S | 7/2013 | Johnson et al. | |
| 8,507,077 | B1 * | 8/2013 | Bentley | B41M 3/008 428/195.1 |
| D754,444 | S | 4/2016 | Williams | |
| D774,785 | S | 12/2016 | Clarke et al. | |
| 9,631,900 | B1 | 4/2017 | McIntosh et al. | |
| D804,830 | S | 12/2017 | Rosswog | |
| D814,806 | S | 4/2018 | Kewekordes | |
| D843,738 | S | 3/2019 | Raeburn | |
| D856,006 | S | 8/2019 | Kuncaitis | |
| D874,158 | S | 2/2020 | Kewekordes | |
| D874,835 | S | 2/2020 | Stier | |
| 2003/0092341 | A1 | 5/2003 | Curtis et al. | |
| 2011/0151191 | A1 * | 6/2011 | Cincotti | F41H 3/02 428/143 |
| 2015/0239159 | A1 | 8/2015 | Leonhardt et al. | |
| 2019/0040562 | A1 | 2/2019 | Moon | |
| 2020/0056861 | A1 | 2/2020 | Hulst et al. | |

OTHER PUBLICATIONS

Cool Purple and Pink Concentric Circle Pattern via Internet Wayback Machine http://www.prettypatterngifts.com/cool-purple-pink-circles-pattern-gifts.html; https://web.archive.org/web/20160807175613/http://www.prettypatterngifts.com/cool-purple-pink-circles-pattern-gifts.html (Year: 2016).*

Free Geometric Camo Pattern via Internet Wayback Machine https://patterncooler.com/triangle/geometric_camouflage; https://web.archive.org/web/20160618230514/https://patterncooler.com/triangle/geometric_camouflage (Year: 2016).*

Quilt Patterns Oct. 24, 2017 https://www.quiltingdaily.com/friday-free-quilt-patterns-painted-desert-mccalls-quilting-blog/ (Year: 2017).*

"QuiltCon here we come!" by Lady Harvatine (http://www.ladyharvatine.com/2013/02/quiltcon-here-we-come.html, Feb. 20, 2013) (Year: 2013).*

"Concentric Triangles Pattern Art Print" (https://society6.com/product/concentric-triangles-pattern_print; Reviewed on Jun. 26, 2018) (Year: 2018).*

Kikkoumon (JAANUS, Japanese Architecture and Art Net Users System; http://www.aisf.or.jP/~jaanus/deta/k/kikkoumon.htm, copyright 2001) (Year: 2001).*

47. "Concentric Polygon Background" (https://www.youworkforthem.com/graphic/E4505/20-concentric-polygons-backgrounds; posted on Nov. 8, 2018) (Year: 2018).* https://www.istockphoto.com/vector/decorative-geometric-pattern-vector-gm802314584-130161155 (Year: 2017).*

International Search Report and Written Opinion of the International Searching Authority dated Dec. 12, 2019, in International Patent Application No. PCT/US2019/046578, 6 pages.

* cited by examiner

SUBSTRATE WITH CAMOUFLAGE PATTERN

CROSS-REFERENCE TO RELATED APPLICATION

This application claims the benefit of priority from U.S. Patent Application No. 62/718,887, filed Aug. 14, 2018, the contents of which is incorporated herein by reference in its entirety.

FIELD OF THE INVENTION

This application relates to camouflage.

BACKGROUND OF THE INVENTION

Camouflage patterns have historically been used for military clothing, gear and equipment. The objective of camouflage is to enable the wearer or some other object to blend in with the surroundings. Camouflage patterns may also be incorporated into military style products of other fashion styles in commercial markets.

SUMMARY OF THE INVENTION

In one aspect of the invention, an article includes a surface having a camouflage pattern printed thereon. The camouflage pattern may include a plurality of shapes such that each shape has at least three portions $P_1$ to $P_N$, where N is an integer greater than or equal to 3, each portion $P_1$ to $P_N$ being a different shade of a color than other portions of the portions $P_1$ to $P_N$, the at least three portions being arranged relative to the border of the shape such that a first portion $P_1$ extends around the border of the shape and each of the remaining portions $P_2$ to $P_N$ are arranged such that for a given portion $P_i$, i=2 to N, is located completely surrounded by a portion $P_{i-1}$ The article may have the portions $P_1$ to $P_N$ of each shape of the plurality of shapes arranged such that each portion $P_i$, i=2 to N, is a darker shade of the color than portion $P_{i-1}$. The article may have the portions $P_1$ to $P_N$ of each shape of the plurality of shapes arranged such that each portion $P_i$, i=2 to N, is a lighter shade of the color than portion $P_{i-1}$.

The colors of the plurality of shapes include at least five colors and N may be three in some embodiments.

In some embodiments, outer perimeters of the portions $P_1$ to $P_N$ correspond to an appearance of a topographical map.

In some embodiments, the perimeters of the portions $P_1$ to $P_N$ of each shape each includes a plurality of straight lines including at least one acute angle. The acute angle of the perimeter of the portion P1 may protrude into another shape of the plurality of shapes. The border of each shape of the plurality of shapes may be adjacent at least two other shapes of the plurality of shapes.

In some embodiments, the camouflage pattern includes an upper edge, a lower edge opposite the upper edge, a left edge extending between the upper edge and the lower edge, and a right edge opposite the left edge and extending between the upper edge and the lower edge, the upper, lower, right edge, and left edge defining a rectangular shape, the camouflage pattern being such that the lower edge of the camouflage pattern is a continuation of the upper edge of the camouflage pattern and the right edge of the camouflage pattern is a continuation of the left edge of the camouflage pattern.

In some embodiments, the camouflage pattern is formed of threads such that threads forming each shape of the plurality of shapes are oriented in a different direction than threads forming shapes of the plurality of shapes adjacent each shape.

The article may be an article of clothing, a vehicle of other covering material. The camouflage pattern may be formed on a vinyl wrap applied to the article.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The preferred and alternative embodiments of the present invention are described in detail below with reference to the following drawings.

DETAILED DESCRIPTION OF THE INVENTION

FIGS. 1A through 4 illustrate a camouflage pattern having a unique pattern that is based on topographical maps that use contour lines to illustrate elevation on a 2-dimensional surface. The "E3D" pattern, like other camouflage patterns, is a series of random shapes that are butted up against one another. This pattern, however, uses straight lines that come together at acute and obtuse angles to form angular shapes. These shapes form an enclosed area that is divided into three sections that are offset from the main shape border having a similarly shaped outline, much like the contour lines on a map. Each shape is assigned a base color, of which there may be at least three, preferably five, total. The three sections within each shape are filled in with a shade of that base color. The shape sections transition from light to dark or dark to light, moving from the shape border to the center. Each shape in the pattern has at least one border that borders two other shapes. This border may be a straight line or a line with a bend in it. In these instances, the single shape includes a triangular protrusion, known as a "thorn," which separates the other two adjacent shapes. This serves to break up the linear border and to form a more cohesive pattern.

Figure 4:
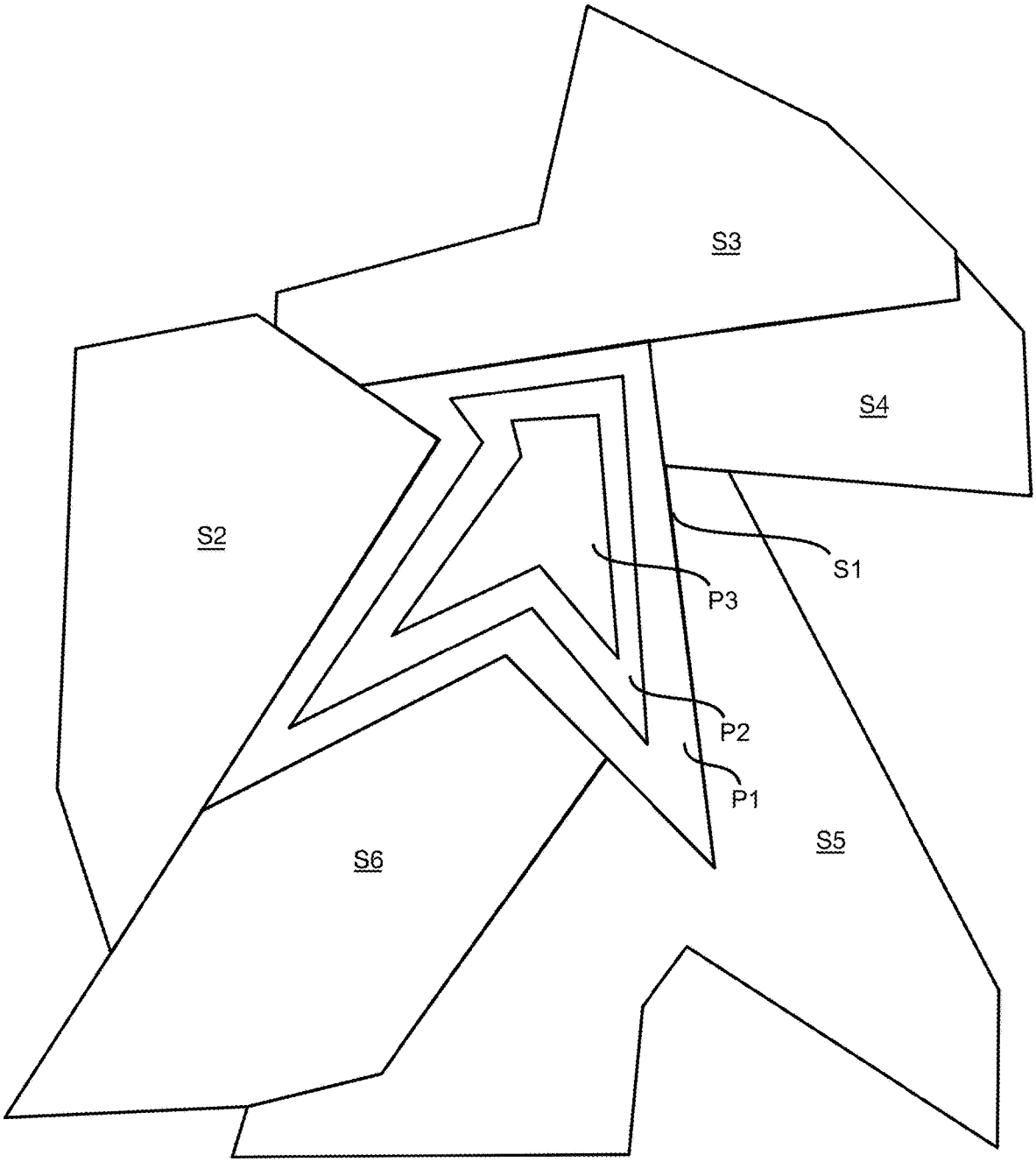
FIG. 4 shows shapes and shading of the camouflage pattern in accordance with an embodiment of the invention as line work.

For example, referring to FIG. 4, shape S1 is a border of a number of shapes S1 to S6 of the pattern. Within shape S1 are N different portions $P_0$ to $P_N$, where N is an integer, such as an integer greater than or equal to 3. The shape S1 has a base color (green, gray, brown, etc.) and each portion $P_0$ to $P_N$ is a different shade of that color. As is apparent in FIG. 4, the portions $P_0$ to $P_N$ are arranged relative to the border of the shape S1 such that a first portion $P_1$ extends around the border of the shape and each of the remaining portions $P_2$ to $P_N$ are arranged such that for a given portion $P_i$, i=2 to N, is located within, i.e. completely surrounded by, a portion $P_{i-1}$.

The portions $P_1$ to $P_N$ of the shape S1 may be arranged such that each portion $P_i$, i=2 to N is a darker shade of the base color than portion $P_{i-1}$. Alternatively, the portions $P_1$ to $P_N$ of the shape S1 may be arranged such that each portion $P_i$, i=2 to N, is a lighter shade of the base color than portion $P_{i-1}$.

As is apparent, the perimeters of the portions $P_1$ to $P_N$ correspond in appearance to a topographical map. For example, the perimeter of a given portion $P_i$, i=2 to N, is a gradual transformation of the perimeters of portions $P_{i-1}$ and $P_{i+1}$. For example, the shape S1 may include straight lines defining acute or obtuse angles. The perimeters of portions $P_2$ to $P_N$ may therefore include the same number of straight lines, acute angles and obtuse angles with the lengths of the lines and sizes of the angles being gradually transitioned from one portion $P_i$ to the next portion $P_{i+1}$, e.g., the angle at each corner of one portion $P_i$ changes by less than 15% relative to the closest corner of the next portion $P_{i+1}$.

FIG. 4 further illustrates various "thorns" that may be defined by a shape S1, i.e., lines coming together to form an actuate inner angle. For example, shape S1 defines a thorn that protrudes into shape S5. S1 further defines a thorn protruding between shapes S2 and S6 and one protruding between shapes S2 and S3.

The design of the pattern may have the versatility to be able to be applied to objects of all shapes and sizes. To accomplish this, the pattern design has the shape of a large square or tile. There may be various versions of the tile, such as three versions of the tile: 100% or 1:1 scale, small scale, and large scale. Each scale may be used for a category of objects. For example, the 1:1 scale may be used on personal transportation devices such as skateboard, scooters, bicycles and the like or large hand-held items such as a helmet, firearm, tool, etc. The small scale may be used on small items such as mobile phone cases. The large scale may be used for large objects such as cars and trucks, motorcycles, billboards, etc.

Figure 1A:
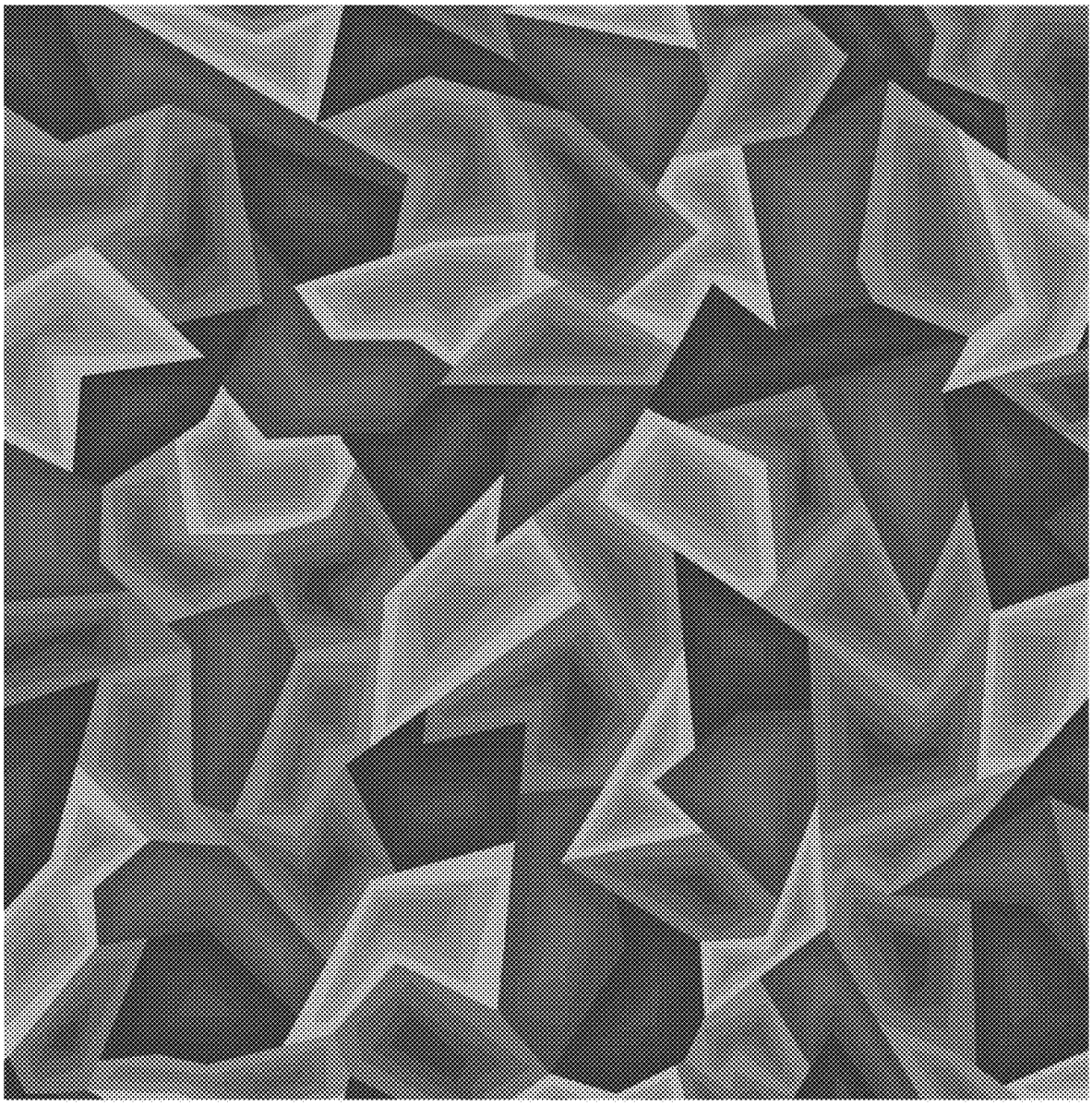
FIGS. 1A and 1B show a camouflage pattern in accordance with an embodiment of the invention in color.
Figure 1B:
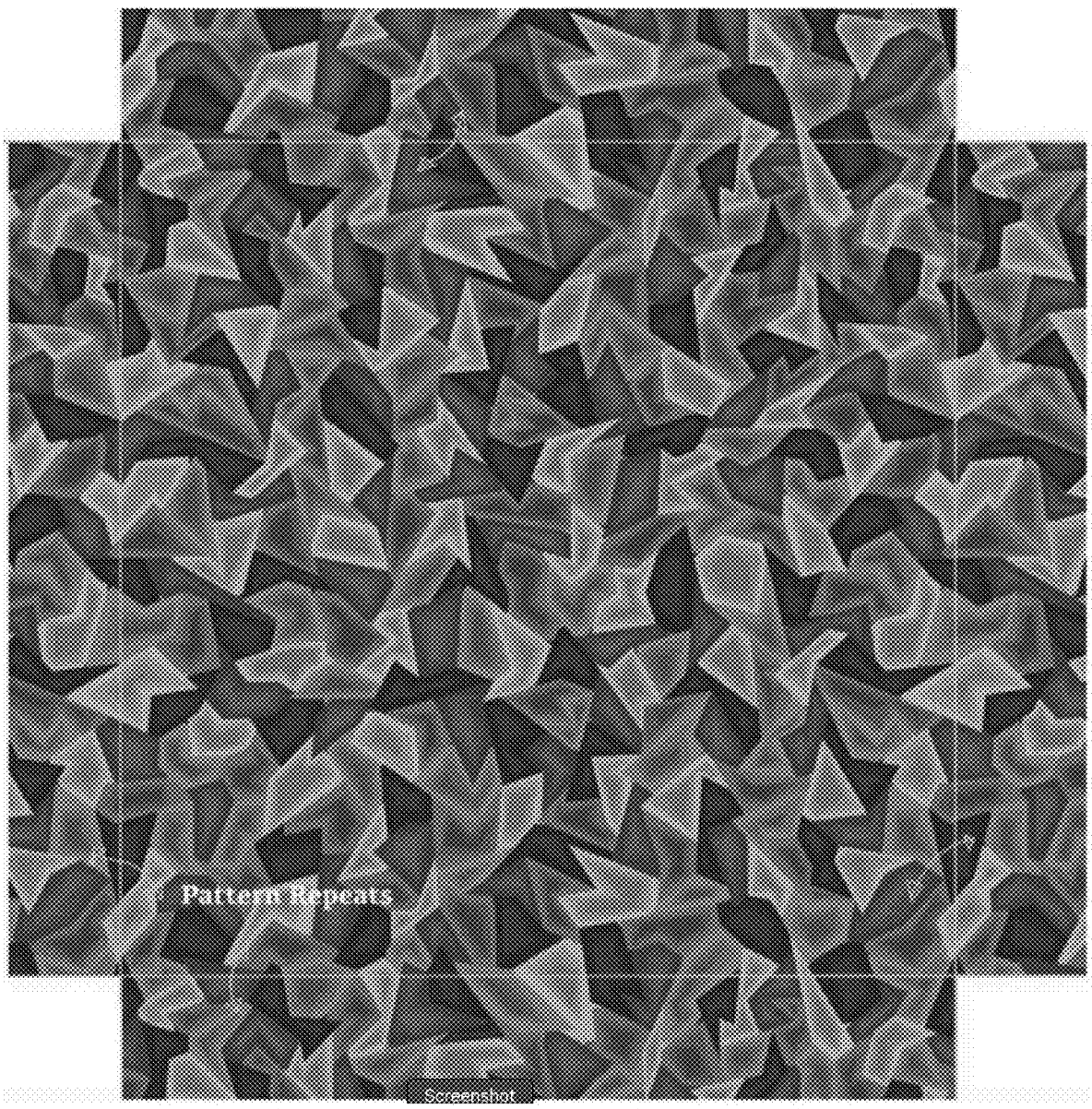
Figure 2:
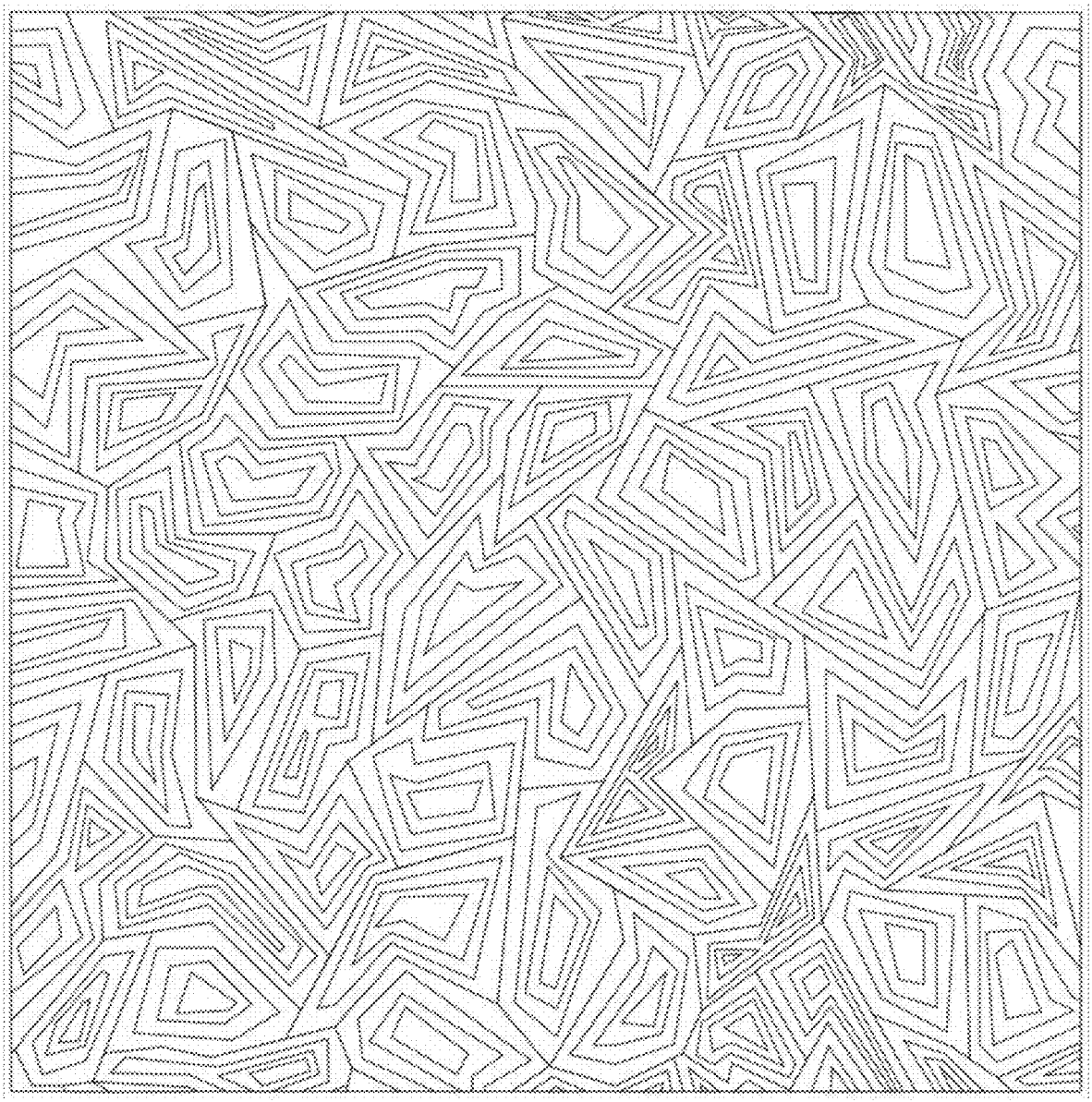
FIG. 2 shows the camouflage pattern in accordance with an embodiment of the invention as line work.
Figure 3A:
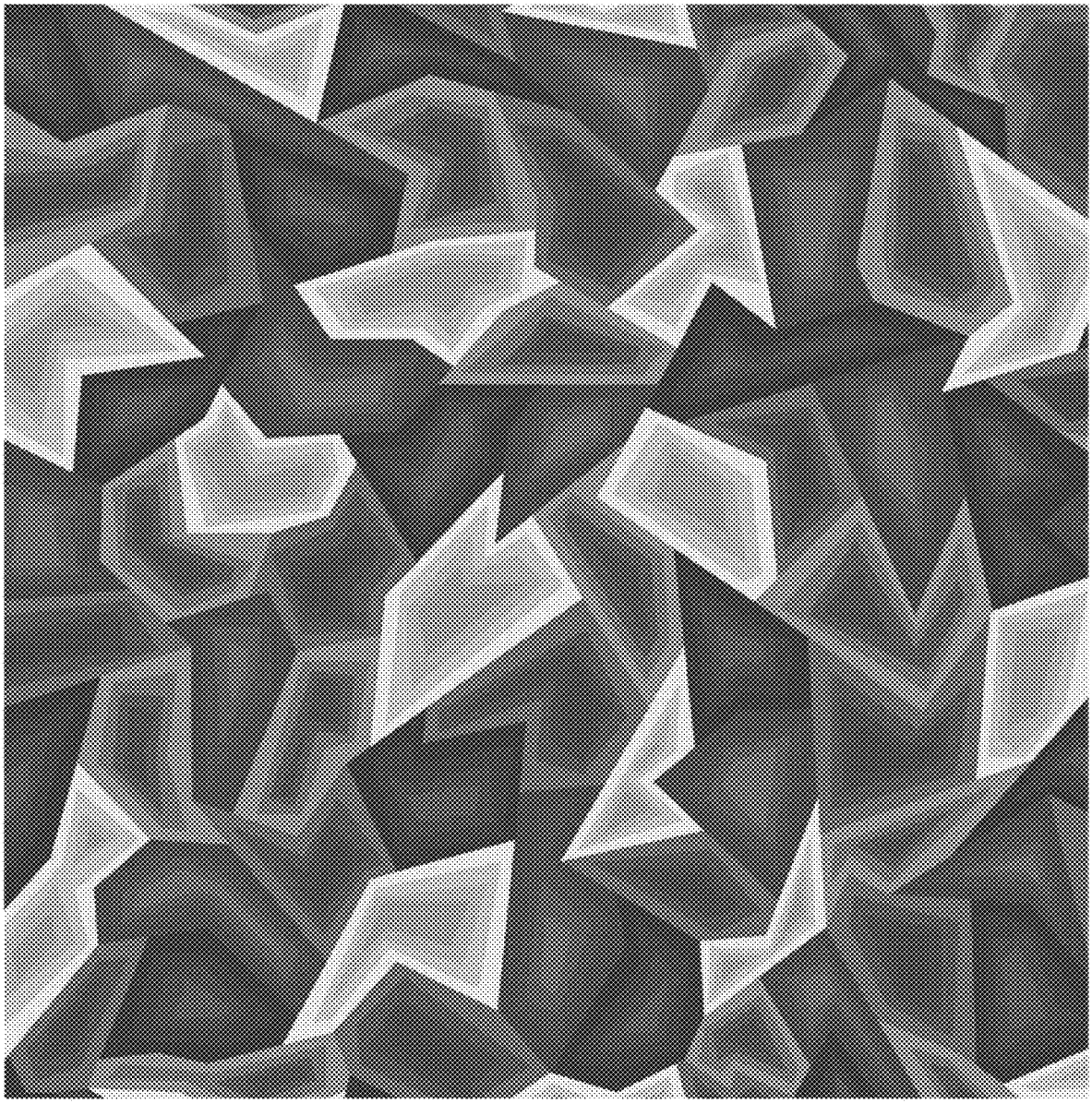
FIGS. 3A and 3B show the camouflage pattern in accordance with an embodiment of the invention in grayscale.
Figure 3B:
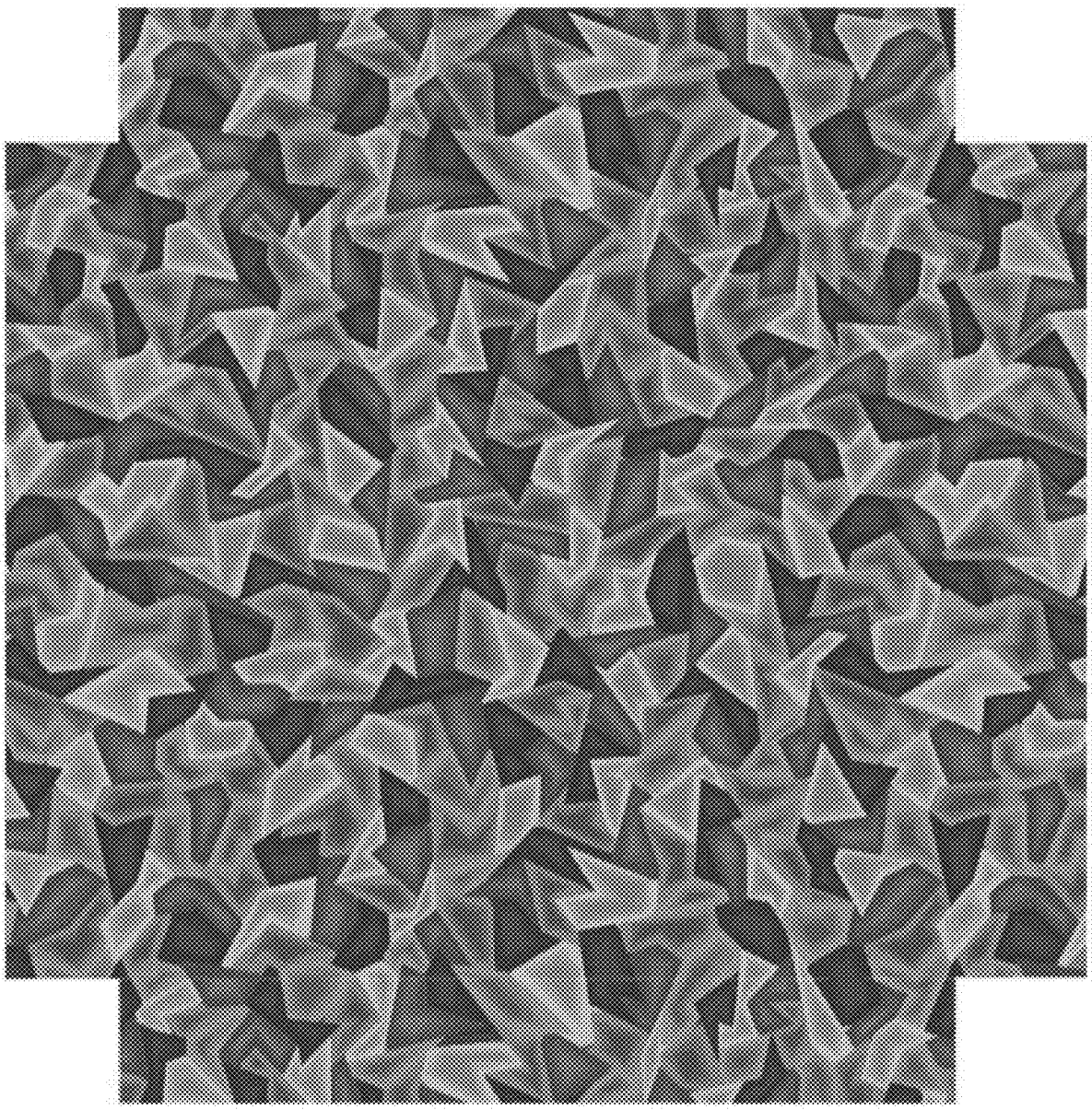

As shown in FIGS. 1B and 3B, the pattern may be designed to be tessellated in such a way that the right-most border of the pattern is continuous with the left-most border and the top-most border is continuous with the bottom-most border. This allows the pattern to be adaptable to an object whose size or shape requires an overlay that exceeds the size of the pattern in any direction. An example of this is an overlay for a slender object that is much longer than it is wide. In this case, the overlay may be larger than the pattern itself and would extend beyond the pattern border. This is possible because of the "wrapping" nature of the pattern.

The E3D pattern could be used on any products, marketing material, or advertisements. The pattern may be applied to irregularly-shaped small to medium products by way of water transfer printing, wherein an object is submerged into water with a film on the surface that is transferred to the object. Examples of such products include helmets, motorcycle fuel tanks or fenders, car wheels, water bottles, automotive interior parts, firearm components, and the like. The pattern may be applied to vehicles and large objects as a vinyl wrap or similar covering application.

The pattern may be CNC-machined into plastic or metallic objects where each portion $P_1$ to $P_N$ of a shape group is machined at a slightly different elevation to give the pattern depth. The shapes may be machined so that the shapes project out of the surface or into the surface.

The pattern may be woven or embroidered into a fabric so that each section of a shape group contains threads that are oriented in different directions. This may also allow the pattern to have depth. In this way, the pattern would be discernible even though the fabric may only be made of one color. The pattern may also be woven using a different color for each color group while using the thread orientation for contrast between each section of the color group.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. An article comprising:

a surface having a camouflage pattern formed thereon, wherein the camouflage pattern comprises only a plurality of shapes such that each shape of the plurality of shapes has at least three portions P1 to PN, where N is an integer greater than or equal to 3, each portion P1 to PN being a different shade of a color than other portions of the portions P1 to PN, the portions P1 to PN being arranged relative to a border of the each shape such that a first portion P1 extends around the border of the each shape and each of the portions P2 to PN are arranged such that for a given portion Pi, i=2 to N, is located completely surrounded by a portion Pi-1 and perimeters of the portions P1 to PN of each shape of the plurality of shapes each includes a plurality of straight lines including at least one acute angle and at least one obtuse angle;

wherein the plurality of shapes include first shapes having both sides of the at least one acute angle of the perimeter of the portion P1 of each first shape abutting a border of one shape of the plurality of shapes.

2. The article of claim 1, wherein the portions $P_1$ to $P_N$ of each shape of the plurality of shapes are arranged such that each portion Pi, I=2 to N, is a darker shade of the color than portion Pi-1.

3. The article of claim 1, wherein the portions P1 to PN of each shape of the plurality of shapes are arranged such that each portion Pi, I=2 to N, is a lighter shade of the color than portion Pi-1.

4. The article of claim 1, wherein the colors of the plurality of shapes include at least five colors.

5. The article of claim 1, wherein N is three.

6. The article of claim 1, wherein outer perimeters of the portions P1 to PN correspond to an appearance of a topographical map.

7. The article of claim 1, wherein the border of each shape of the plurality of shapes is adjacent to at least two other shapes of the plurality of shapes.

8. The article of claim 1, wherein the camouflage pattern includes an upper edge, a lower edge opposite the upper edge, a left edge extending between the upper edge and the lower edge, and a right edge opposite the left edge and extending between the upper edge and the lower edge, the upper, lower, right edge, and left edge defining a rectangular shape, the camouflage pattern being such that the lower edge of the camouflage pattern is a continuation of the upper edge of the camouflage pattern and the right edge of the camouflage pattern is a continuation of the left edge of the camouflage pattern.

9. The article of claim 1, wherein the camouflage pattern is formed of threads such that threads forming each shape of the plurality of shapes are oriented in a different direction than threads forming shapes of the plurality of shapes adjacent each shape.

10. The article of claim 1, wherein the article is an article of clothing.

11. The article of claim 1, wherein the article is a vehicle.

12. The article of claim 11, wherein the camouflage pattern is formed on a vinyl wrap applied to the vehicle.

13. The article of claim 1, wherein the article is a tool.

14. The article of claim 1, wherein the article is a firearm.

15. The article of claim 1, wherein the article is a personal transportation device.

16. An article comprising:

a surface having a camouflage pattern printed thereon, wherein the camouflage pattern comprises only a plurality of shapes such that each shape has at least three portions $P_1$ to $P_N$, where N is an integer greater than or equal to 3, each portion $P_1$ to $P_N$ being a different shade of color than other portions of the portions $P_1$ to $P_N$, the portions $P_1$ to $P_N$ being arranged relative to a border of the each shape such that a first portion $P_1$ extends around the border of the each shape and each of the portions $P_2$ to $P_N$ are arranged such that for a given portion $P_i$, I=2 to N, is located completely surrounded by a portion $P_{i-1}$, each shape of the plurality of shapes including both one or more acute angles and one or more obtuse angles; and wherein the portions $P_1$ to $P_N$ of each shape of the plurality of shapes are arranged such that the perimeter of each portion $P_i$, I=2 to N−1, is a transformation of the perimeters of portions $P_{i-1}$ and $P_{i+1}$ such that perimeters of portions $P_2$ to $P_N$ include a same number of straight lines, number of the one or more acute angles and number of the one or more obtuse angles.

17. The article of claim 16, wherein the portions $P_1$ to $P_N$ of each shape of the plurality of shapes are arranged such that each angle of the one or more acute angles and the one or more obtuse angles of each portion $P_i$, I=2 to N−1, is a transition from each portion Pi to the portion $P_{i+1}$ such that each angle changes relative to a closest corner of the portion Pi+1, the change being no more than 15 percent.

* * * * *